US006506124B1

(12) United States Patent
Manwaring et al.

(10) Patent No.: US 6,506,124 B1
(45) Date of Patent: Jan. 14, 2003

(54) METHOD FOR PREDICTING A GOLFER'S BALL STRIKING PERFORMANCE

(75) Inventors: Scott R. Manwaring, Vista, CA (US); Frank H. Fan, Carlsbad, CA (US); Peter Ligotti, III, Encinitas, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/683,396

(22) Filed: Dec. 21, 2001

(51) Int. Cl.[7] ..... A63B 69/36

(52) U.S. Cl. ..... 473/198; 473/409; 473/200; 73/432.1

(58) Field of Search ..... 473/409, 131, 473/150, 152, 155, 351, 198, 199, 200; 463/3

(56) References Cited

U.S. PATENT DOCUMENTS

| | | | | |
|---|---|---|---|---|
| 4,063,259 | A | | 12/1977 | Lynch et al. |
| 4,136,387 | A | | 1/1979 | Sullivan et al. |
| 4,360,199 | A | | 11/1982 | Jackson |
| 4,375,887 | A | * | 3/1983 | Lynch et al. |
| 4,580,786 | A | | 4/1986 | Shipley |
| 5,269,177 | A | | 12/1993 | Miggins et al. |
| 5,309,753 | A | | 5/1994 | Johnson |
| 5,375,844 | A | | 12/1994 | Waud |
| 5,471,383 | A | | 11/1995 | Gobush et al. |
| 5,501,463 | A | | 3/1996 | Gobush et al. |
| 5,575,719 | A | | 11/1996 | Gobush et al. |
| 5,582,552 | A | | 12/1996 | Hofmeister |
| 5,625,577 | A | | 4/1997 | Kunii et al. |
| 5,672,809 | A | | 9/1997 | Brandt |
| 5,682,230 | A | | 10/1997 | Anfinsen et al. |
| 5,694,340 | A | | 12/1997 | Kim |
| 5,697,791 | A | | 12/1997 | Nashner et al. |
| 5,779,241 | A | | 7/1998 | D'Costa et al. |
| 5,803,823 | A | | 9/1998 | Gobush et al. |
| 5,899,822 | A | | 5/1999 | Yamagishi et al. |
| 6,042,483 | A | | 3/2000 | Katayama |
| 6,224,499 | B1 | | 1/2001 | Ogg |
| 6,186,002 | B1 | | 2/2001 | Lieberman et al. |
| 6,328,660 | B1 | | 12/2001 | Bunn, III |

* cited by examiner

*Primary Examiner*—Paul T. Sewell
*Assistant Examiner*—Nini Legesse
(74) *Attorney, Agent, or Firm*—Michael A. Catania

(57) ABSTRACT

A method for a predicting golfer's performance is disclosed herein The method inputs the pre-impact swing properties of a golfer, a plurality of mass properties of a first golf club, and a plurality of mass properties of a first golf ball into a rigid body code. Ball launch parameters are generated from the rigid body. The ball launch parameters, a plurality of atmospheric conditions and lift and drag properties of the golf ball are inputted into a trajectory code. This trajectory code is used to predict the performance of a golf ball if struck by the golfer with the golf club under the atmospheric conditions. The method can then predict the performance of the golf ball if struck by the golfer with a different golf club. The method and system of the present invention predict the performance of the golf ball without the golfer actually striking the golf ball.

21 Claims, 15 Drawing Sheets

| POINT | WORLD X | WORLD Y | WORLD Z | ERROR | DISTANCE | CamO X | CamO Y |
|---|---|---|---|---|---|---|---|
| 301 | -86.762 | -61.571 | -288.862 | 0.347 | 0.000 | 350.000 | 657.000 |
| 302 | -74.308 | -53.481 | -317.631 | 0.084 | 0.000 | 332.000 | 708.000 |
| 303 | 16.055 | 4.874 | -342.577 | 0.051 | 0.000 | 175.000 | 782.000 |
| 304 | -26.932 | 3.129 | -371.397 | 0.146 | 0.000 | 254.000 | 825.000 |
| 305 | -19.786 | 3.871 | -343.333 | 0.021 | 0.000 | 238.000 | 779.000 |
| 306 | -64.463 | -31.024 | -339.310 | 0.140 | 0.000 | 317.000 | 753.000 |
| 307 | -66.308 | -27.403 | -367.273 | 0.023 | 0.000 | 323.000 | 800.000 |
| 308 | -44.758 | -11.521 | -354.379 | 0.108 | 0.000 | 284.000 | 788.000 |

| POINT | WORLD X | WORLD Y | WORLD Z | ERROR | DISTANCE | CamO X | CamO Y | Cam1 Y | Cam1 Y |
|---|---|---|---|---|---|---|---|---|---|
| 1 | 25.403 | -88.666 | -273.087 | 0.111 | 0.000 | 242.515 | 645.011 | 207.000 | 604.248 |
| 2 | 25.721 | -69.464 | -298.941 | 0.029 | 0.000 | 241.496 | 693.577 | 217.137 | 651.683 |
| 3 | 9.897 | -87.512 | -272.644 | 0.030 | 0.000 | 268.582 | 644.080 | 232.530 | 601.725 |
| 4 | 9.769 | -67.875 | -298.553 | 0.070 | 0.000 | 268.638 | 692.660 | 243.845 | 649.186 |
| 5 | -5.735 | -87.007 | -272.220 | 0.023 | 0.000 | 294.857 | 642.971 | 257.675 | 599.105 |
| 6 | -6.311 | -67.238 | -298.038 | 0.143 | 0.000 | 296.011 | 691.479 | 269.969 | 645.958 |
| 7 | -21.271 | -86.103 | -271.525 | 0.006 | 0.000 | 320.897 | 641.474 | 282.607 | 596.242 |
| 8 | -22.270 | -66.534 | -297.401 | 0.038 | 0.000 | 323.118 | 689.855 | 295.663 | 642.865 |
| 9 | -36.700 | -85.210 | -270.598 | 0.143 | 0.000 | 346.708 | 639.492 | 307.112 | 593.156 |
| 10 | -38.391 | -66.149 | -296.520 | 0.132 | 0.000 | 350.431 | 687.885 | 321.133 | 639.137 |
| 11 | -52.402 | -84.929 | -269.717 | 0.114 | 0.000 | 372.918 | 637.555 | 331.442 | 589.850 |
| 12 | -54.388 | -65.649 | -295.440 | 0.133 | 0.000 | 377.461 | 685.556 | 346.190 | 635.256 |
| 13 | 57.162 | 34.188 | -312.472 | 0.108 | 0.000 | 174.069 | 756.568 | 218.724 | 713.629 |
| 14 | 39.036 | 35.111 | -312.274 | 0.148 | 0.000 | 207.939 | 755.624 | 251.265 | 710.126 |
| 15 | 20.973 | 36.864 | -311.607 | 0.131 | 0.000 | 241.528 | 754.119 | 283.744 | 706.195 |
| 16 | 2.772 | 37.989 | -310.857 | 0.051 | 0.000 | 275.386 | 752.137 | 315.686 | 701.974 |
| 17 | -15.330 | 39.292 | -309.880 | 0.186 | 0.000 | 308.983 | 750.018 | 347.139 | 697.297 |
| 18 | -33.449 | 40.473 | -308.726 | 0.063 | 0.000 | 342.554 | 747.174 | 378.164 | 692.663 |
| 19 | -132.128 | -0.469 | -314.181 | 0.027 | 0.000 | 517.000 | 735.500 | 506.250 | 672.250 |

*FIG. 6B*

| | GOLFER A | GOLFER B | |
|---|---|---|---|
| 1 | 100 | 100 | USECS |
| 2 | 474.64 | 445.24 | |
| 3 | 849.28 | 790.48 | |
| 4 | 1223.92 | 1135.72 | |
| 5 | 1598.56 | 1480.96 | |
| 6 | 1973.2 | 1826.2 | |

| | GOLFER A | | | | GOLFER B | | |
|---|---|---|---|---|---|---|---|
| POINT | x | y | z | | x | y | z |
| 1 | 22.5248 | -83.9985 | -277.294 | mm | 19.041 | -72.461 | -259.712 |
| 2 | 24.169 | -65.4006 | -303.476 | | 22.4965 | -55.2863 | -286.794 |
| 3 | 7.19187 | -82.9872 | -277.522 | | 4.01986 | -70.4449 | -259.675 |
| 4 | 8.42472 | -64.3227 | -303.821 | | 7.01569 | -53.2288 | -286.847 |
| 5 | -8.13186 | -82.1665 | -277.659 | | -10.9967 | -69.261 | -259.648 |
| 6 | -7.22265 | -63.5248 | -303.832 | | -8.4661 | -51.7105 | -286.751 |
| 7 | -23.3764 | -81.5513 | -277.808 | | -26.1186 | -68.0642 | -259.411 |
| 8 | -23.0235 | -62.4671 | -303.799 | | -24.0434 | -50.5302 | -286.55 |
| 9 | -38.7101 | -81.1989 | -277.632 | | -41.2492 | -66.9375 | -259.08 |
| 10 | -38.7728 | -62.1541 | -303.773 | | -39.6559 | -49.2957 | -286.093 |
| 11 | -53.8825 | -80.338 | -277.333 | | -56.2913 | -65.3794 | -258.417 |
| 12 | -54.3404 | -61.5229 | -303.473 | | -55.2933 | -48.2721 | -285.617 |
| 13 | 55.757 | 37.5722 | -317.082 | | 52.9912 | 47.9439 | -304.485 |
| 14 | 38.0195 | 39.5086 | -317.184 | | 35.5873 | 50.1247 | -304.708 |
| 15 | 20.3043 | 41.514 | -317.408 | | 18.3605 | 52.5852 | -304.554 |
| 16 | 2.59074 | 42.9978 | -317.464 | | 0.955063 | 54.6563 | -304.407 |
| 17 | -15.4104 | 43.8896 | -317.378 | | -16.5273 | 56.2923 | -303.924 |
| 18 | -33.2143 | 45.1303 | -316.736 | | -33.9984 | 57.8887 | -303.17 |
| 19(BALL) | -133.559 | -3.897 | -315.635 | | -133.559 | -3.897 | -315.635 |

203.9

STATIC IMAGE POINTS

| | GOLFER A | | | | GOLFER B | | |
|---|---|---|---|---|---|---|---|
| POINT | x | y | z | | x | y | z |
| 1 | -86.2027 | -59.7842 | -288.178 | mm | -86.2027 | -59.7842 | -288.178 |
| 2 | -73.7585 | -51.7931 | -317.232 | | -73.7585 | -51.7931 | -317.232 |
| 3 | 16.84 | 7.93595 | -341.742 | | 16.84 | 7.93595 | -341.742 |
| 4 | -26.4742 | 4.66858 | -370.935 | | -26.4742 | 4.66858 | -370.935 |
| 5 | -19.7858 | 3.87145 | -343.333 | | -19.7858 | 3.87145 | -343.333 |
| 6 | -64.4634 | -31.0241 | -339.31 | | -64.4634 | -31.0241 | -339.31 |
| 7 | -66.9001 | -27.2861 | -367.303 | | -66.9001 | -27.2861 | -367.303 |
| 8 | -44.8512 | -9.84895 | -353.971 | | -44.8512 | -9.84895 | -353.971 |

*FIG. 11*

202

CLUB HEAD PROPERTIES

401

| FACE PROPERTIES | STEEL | Ti | |
|---|---|---|---|
| FACEANGLE | 0 | 0 | DEGREE |
| FACEBOTTOMCENTER | | | |
| x | -0.714 | -0.795 | INCH |
| y | 0.756 | 0.643 | |
| z | 0.17 | 0.197 | |
| FACECENTER | | | |
| x | 0 | 0 | |
| y | 0.756 | 0.643 | |
| z | 0.949 | 1.21 | |
| BULGE | 9.5 | 11 | INCH |
| ROLL | 11 | 11 | |

402

| MASS PROPERTIES | | | |
|---|---|---|---|
| MASS | 197 | 187 | GRAM |
| CGX | 0.423 | 0.634 | INCH |
| CGY | 0.664 | 0.574 | |
| CGZ | 0.871 | 0.9899 | |
| MOIxx | 1737 | 2291 | GRAMCM2 |
| MOIyy | 1378 | 1781 | |
| MOIzz | 2337 | 2871 | |
| MOIxy | 213 | 247 | |
| MOIxz | -18 | -12 | |
| MOIyz | 113 | 164 | |

403

| | | | |
|---|---|---|---|
| COR | 0.785 | 0.865 | |

404

| | | | |
|---|---|---|---|
| LOFT | 11 | 13 | DEGREE |
| LIE | 55 | 55 | |

| | | | |
|---|---|---|---|
| HOSELHEIGHT | 0 | 0 | |
| SPINCOR | 0 | 0 | |

*FIG. 12*

204

PRE-IMPACT SWING PROPERTIES

| | | GOLFER A | GOLFER B | (AVERAGES) |
|---|---|---|---|---|
| 409 | LINEAR VELOCITY | | | |
| | VX | -100.07 | -107.35 | MPH |
| | VY | -2.12 | 18.04 | |
| | VZ | 5.63 | 9.99 | |
| 410 | ANGULAR VELOCITY | | | OPTIONAL |
| 411 | ORIENTATION | | | |
| | FACE LOFT VECTOR | | | |
| | x | 0.3251 | 0.27673 | |
| | y | -0.07685 | -0.03143 | |
| | z | 0.942547 | 0.96043 | |
| | FACE LIE VECTOR | | | |
| | x | 0.08157 | 0.08518 | |
| | y | 0.9953 | 0.99633 | |
| | z | 0.05302 | 0.00806 | |
| | FACE NORMAL VECTOR | | | |
| | x | -0.94215 | -0.95716 | |
| | y | 0.05965 | 0.07958 | |
| | z | 0.32984 | 0.2784 | |
| | SHAFT VECTOR | | | |
| | x | -0.05612 | -0.01957 | |
| | y | 0.57527 | 0.500194 | |
| | z | -0.81603 | -0.8657 | |
| 412 | IMPACT LOCATION | | | |
| | x | 0.21 | -0.38 | INCH |
| | y | 0.41 | -0.16 | |

FIG. 13

206

GOLF BALL PROPERTIES

| | | TWO PIECE | THREE PIECE | |
|---|---|---|---|---|
| 405 | MASS | 45.387 | 45.23 | GRAM |
| 406 | RADIUS | | | |
| | DIAMETER | 1.68 | 1.678 | INCH |
| 407 | MOMENT | 1.34E-03 | 1.04E-03 | 0INCHS2 |
| 408 | COR | 0.759 | 0.7455 | |

FIG. 14

210 BALL LAUNCH PARAMETERS

| | | POSSIBLE LAUNCH PARAMETERS | | | | | | | | |
|---|---|---|---|---|---|---|---|---|---|---|
| | | GOLFER A STEEL/2PC | STEEL/3PC | Ti/2PC | Ti/3PC | GOLFER B STEEL/2PC | STEEL/3PC | Ti/2PC | Ti/3PC | |
| 416 | BALL LINEAR VELOCITY | 138.3 | 137 | 141.2 | 140.3 | 155.5 | 154.5 | 160.8 | 160 | MPH |
| | VX | 132.6 | 131.2 | 134 | 132.9 | 152.8 | 151.7 | 157 | 156 | |
| | VY | 3.01 | 3.11 | 3.26 | 3.37 | 0.55 | 0.62 | 0.79 | 0.93 | |
| | VZ | 39.2 | 39.5 | 44.4 | 44.9 | 28.9 | 29.5 | 34.8 | 35.4 | |
| 417 | BALL ANGULAR VELOCITY | 2512 | 2667 | 2640 | 2910 | 2820 | 3080 | 2996 | 3280 | MPH |
| 418 | LAUNCH ANGLE | 16.5 | 16.8 | 18.4 | 18.7 | 10.7 | 11 | 12.5 | 12.8 | DEGREE |
| 419 | SIDE ANGLE | 4.4 | 4.5 | 4.2 | 4.3 | 1.1 | 1.2 | 1.3 | 1.5 | DEGREE |
| 420 | BALL SPEED | 138.3 | 137 | 141.2 | 140.3 | 155.5 | 154.5 | 160.8 | 160 | MPH |
| 421 | SPIN | 2512 | 2667 | 2640 | 2910 | 2820 | 3080 | 2996 | 3280 | MPH |
| 422 | SPIN AXIS | 20.784 | 20.724 | 19.172 | 19.089 | 17.56 | 17.436 | 18.845 | 18.705 | DEGREE |

*FIG. 15*

214 ATMOSPHERIC CONDITIONS

| | NICE | COLD | |
|---|---|---|---|
| TEMP | 72 | 43 | F |
| WIND | 0 | 9 | MPH |
| | 0 | 90 | DIRECTION |
| HUMIDITY | 50 | 76 | PERCENT |
| PRESSURE | 29.92 | 30.33 | INCHES |

*FIG. 16*

218 PREDICTED PERFORMANCE

| | PLAYER | GOLFER A | | | | | | | | |
|---|---|---|---|---|---|---|---|---|---|---|
| | WEATHER | NICE | NICE | COLD | COLD | NICE | NICE | COLD | COLD | |
| | DRIVER | STEEL | STEEL | STEEL | STEEL | Ti | Ti | Ti | Ti | |
| | BALL | 2 PIECE | 3 PIECE | 2 PIECE | 3 PIECE | 2 PIECE | 3 PIECE | 2 PIECE | 3 PIECE | |
| 422 | TOTAL DISTANCE | 237 | 235 | 232 | 230 | 239 | 234 | 236 | 232 | YARDS |
| 423 | TOTAL DISPERSION | -159 | -160 | -114 | -113 | -157 | -158 | -111 | -112 | FEET |
| 424 | TRAJECTORY SHAPE | (GRAPH) | (GRAPH) | (GRAPH) | (GRAPH) | (GRAPH) | (GRAPH) | (GRAPH) | (GRAPH) | |
| 424 | TRAJECTORY SHAPE | | | | | | | | | |
| | VERTICAL | 88 | 90 | 87 | 87 | 110 | 115 | 108 | 112 | FEET |
| | HORIZONTAL | 27 | 26 | 14 | 13 | 26 | 26 | 13 | 13 | FEET |

| | PLAYER | GOLFER B | | | | | | | | |
|---|---|---|---|---|---|---|---|---|---|---|
| | WEATHER | NICE | NICE | COLD | COLD | NICE | NICE | COLD | COLD | |
| | DRIVER | STEEL | STEEL | STEEL | STEEL | Ti | Ti | Ti | Ti | |
| | BALL | 2 PIECE | 3 PIECE | 2 PIECE | 3 PIECE | 2 PIECE | 3 PIECE | 2 PIECE | 3 PIECE | |
| 422 | TOTAL DISTANCE | 253 | 254 | 259 | 258 | 261 | 257 | 258 | 255 | YARDS |
| 423 | TOTAL DISPERSION | -116 | -118 | -76 | -75 | -139 | -145 | -91 | -96 | FEET |
| 424 | TRAJECTORY SHAPE | (GRAPH) | (GRAPH) | (GRAPH) | (GRAPH) | (GRAPH) | (GRAPH) | (GRAPH) | (GRAPH) | |
| 424 | TRAJECTORY SHAPE | | | | | | | | | |
| | VERTICAL | 77 | 79 | 75 | 76 | 101 | 107 | 98 | 104 | FEET |
| | HORIZONTAL | 27 | 27 | 15 | 14 | 33 | 33 | 18 | 18 | FEET |

*FIG. 17*

METHOD FOR PREDICTING A GOLFER'S BALL STRIKING PERFORMANCE

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to a method for predicting a golfer's ball striking performance for a multitude of golf clubs and golf balls. More specifically, the present invention relates to a method for predicting a golfer's ball striking performance for a multitude of golf clubs and golf balls without the golfer actually using the multitude of golf clubs and golf balls.

2. Description of the Related Art

For over twenty-five years, high speed camera technology has been used for gathering information on a golfer's swing. The information has varied from simple club head speed to the spin of the golf ball after impact with a certain golf club. Over the years, this information has fostered numerous improvements in golf clubs and golf balls, and assisted golfers in choosing golf clubs and golf balls that improve their game. Additionally, systems incorporating such high speed camera technology have been used in teaching golfers how to improve their swing when using a given golf club.

An example of such a system is U.S. Pat. No. 4,063,259 to Lynch et al., for a Method Of Matching Golfer With Golf Ball, Golf Club, Or Style Of Play, which was filed in 1975. Lynch discloses a system that provides golf ball launch measurements through use of a shuttered camera that is activated when a club head breaks a beam of light that activates the flashing of a light source to provide stop action of the club head and golf ball on a camera film. The golf ball launch measurements retrieved by the Lynch system include initial velocity, initial spin velocity and launch angle.

Another example is U.S. Pat. No. 4,136,387 to Sullivan, et al., for a Golf Club Impact And Golf Ball Launching Monitoring System, which was filed in 1977. Sullivan discloses a system that not only provides golf ball launch measurements, it also provides measurements on the golf club.

Yet another example is a family of patent to Gobush et al., U.S. Pat. No. 5,471,383 filed on Sep. 30, 1994; U.S. Pat. No. 5,501,463 filed on Feb. 24, 1994; U.S. Pat. No. 5,575,719 filed on Aug. 1, 1995; and U.S. Pat. No. 5,803,823 filed on Nov. 18, 1996. This family of patents discloses a system that has two cameras angled toward each other, a golf ball with reflective markers, a golf club with reflective markers thereon and a computer. The system allows for measurement of the golf club or golf ball separately, based on the plotting of points.

Yet another example is U.S. Pat. No. 6,042,483 for a Method Of Measuring Motion Of A Golf Ball. The patent discloses a system that uses three cameras, an optical sensor means, and strobes to obtain golf club and golf ball information.

However, these disclosures fail to provide a system or method that will predict a golfer's performance with a specific golf club or golf ball in different atmospheric conditions, without having the golfer physically strike the specific golf ball with the specific golf club. More specifically, if a golfer wanted to know what his ball striking performance would be like when he hit a CALLAWAY GOLF® RULE 35® SOFTFEEL™ golf ball with a ten degrees CALLAWAY GOLF® BIG BERTHA® ERC® II forged titanium driver, the prior disclosures would require that the golfer actually strike the CALLAWAY GOLF® RULE 35® SOFTFEEL™ golf ball with a ten degrees CALLAWAY GOLF® BIG BERTHA® ERC® II forged titanium driver. Using the prior disclosures, if the golfer wanted to compare his or her ball striking performance for ten, twenty or thirty drivers with one specific golf ball, then the golfer would have use each of the drivers at least once. This information would only apply to the specific golf ball that was used by the golfer to test the multitude of drivers. Now if the golfer wanted to find the best driver and golf ball match, the prior disclosures would require using driver with each golf ball. Further, if the golfer wanted the best driver/golf ball match in a multitude of atmospheric conditions (e.g. hot and humid, cool and dry, sunny and windy, . . . etc.) the prior disclosures would require that the golfer test each driver with each golf ball under each specific atmospheric condition.

Thus, the prior disclosures fail to disclose a system and method that allow for predicting a golfer's ball striking performance for a multitude of golf clubs arid golf balls without the golfer actually using the multitude of golf clubs and golf balls.

SUMMARY OF INVENTION

It is thus an object of the present invention to provide a system and method that allow for predicting a golfer's ball striking performance for a multitude of golf clubs and golf balls without the golfer actually using the multitude of golf clubs and golf balls.

BRIEF DESCRIPTION OF DRAWINGS

FIG. 6B is a graphic of global coordinates of the markers of FIG. 6.

FIG. 11 is a table of the static image points (in millimeters) of FIG. 8 for Golfer A and Golfer B.

FIG. 12 is a table of the golf club head properties of FIGS. 1 and 1A for Golfer A and Golfer B.

FIG. 13 is a table of the pre-impact swing properties of FIGS. 1 and 1C for Golfer A and Golfer B.

FIG. 14 is a table of the golf ball properties of FIGS. 1 and 1B for Golfer A and Golfer B.

FIG. 15 is a table of the ball launch parameters of FIGS. 1 and 1D for Golfer A and Golfer B.

FIG. 16 is a table of the atmospheric conditions of FIG. 1 for a warm day and a cold day.

FIG. 17 is a table of the predicted performance of FIGS. 1 and 1E for Golfer A and Golfer B.

DETAILED DESCRIPTION

Figure 1:
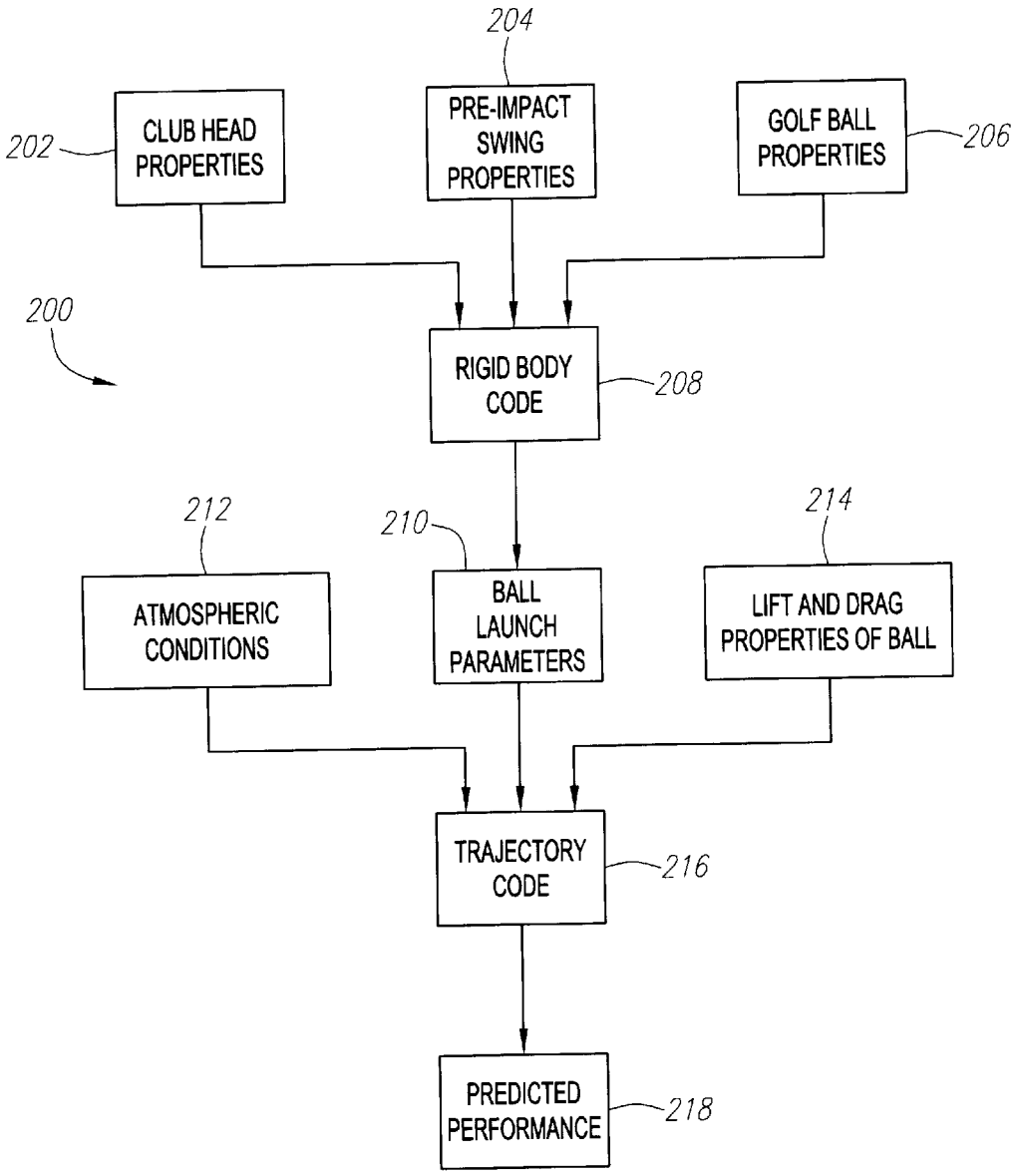
FIG. 1 is a flow chart of the general method of the present invention.

As shown in FIG. 1, a method for predicting a golfer's ball striking performance is generally designated 200. The method 200 commences with inputting information on a specific golf club, specific golf ball, and the swing characteristics of a golfer. At block 202, the club head properties of the specific golf club are selected from a database of stored and previously collected club head information. The specific information for the club head properties is set forth in greater detail below. At block 204, the pre-impact swing properties of the golfer are collected and stored in a database. The specific information for the golfer's pre-impact swing properties is set forth in greater detail below. At block 206, the golf ball properties of the specific golf ball are selected from database of stored and previously collected golf ball information. The specific information for the golf ball properties is set forth in greater detail below.

At block 208, the information from blocks 202, 204 and 206 are inputted into a rigid body code. The rigid body code is explained in greater detail below. At block 210, the rigid body code is used to generate a plurality of ball launch parameters. At block 212, information concerning the atmospheric conditions is selected from a database of stored atmospheric conditions. At block 214, information concerning the lift and drag properties of the golf ball are collected and stored. The lift and drag properties of golf balls are measured using conventional methods such as disclosed in U.S. Pat. No. 6,186,002, entitled Method For Determining Coefficients Of Lift And Drag Of A Golf Ball, which is hereby incorporated by reference in its entirety. The lift and drag coefficients of a number of golf balls at specific Reynolds number are disclosed in U.S. Pat. No. 6,224,499, entitled A Golf Ball With Multiple Sets Of Dimples, which pertinent parts are hereby incorporated by reference.

At block 216, the ball launch parameters, the atmospheric conditions and the lift and drag properties are inputted into a trajectory code. At block 218, the trajectory code is utilized to predict the performance of the golfer when swinging the specific golf club, with the specific golf ball under the specific atmospheric conditions. Trajectory codes are known in the industry, and one such code is disclosed in the afore-mentioned U.S. Pat. No. 6,1 86,002. The USGA has such a trajectory code available for purchase.

Figure 1A:
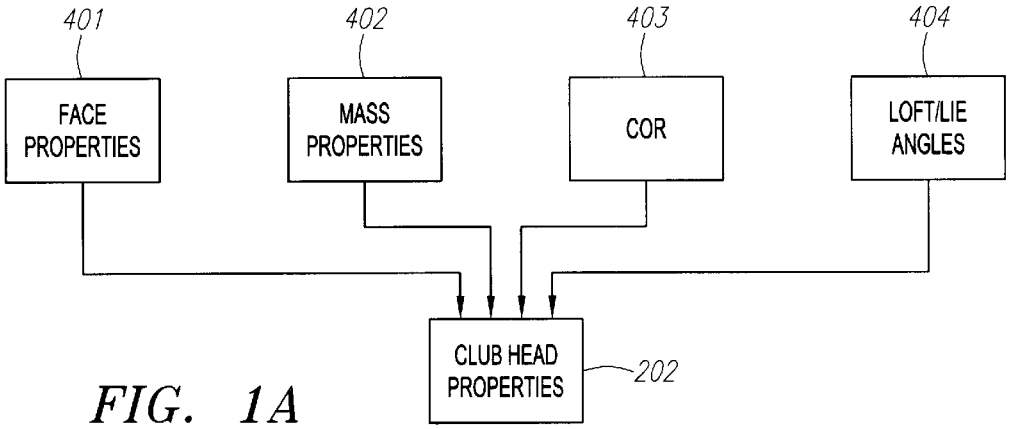
FIG. 1A is a flow chart illustrating the inputs for the golf club head properties.

FIG. 1A is a flow chart illustrating the inputs for the golf club head properties of block 202. The measurements for the face properties are collected at block 401. The face properties include the face geometry, the face center, the bulge radius and the roll radius. The measurements for the mass properties of the golf club head are collected or recalled from a database at block 402. The mass properties include the inertia tensor, the mass of the club head, and the center of gravity location. The measurement for the coefficient of restitution of the golf club head using a specific golf ball is collected at block 403. The measurements for the loft and lie angles of the golf club head are collected at block 404. The data collected at blocks 401–404 is inputted to create the golf club head properties at block 202 of FIG. 1.

Figure 1B:
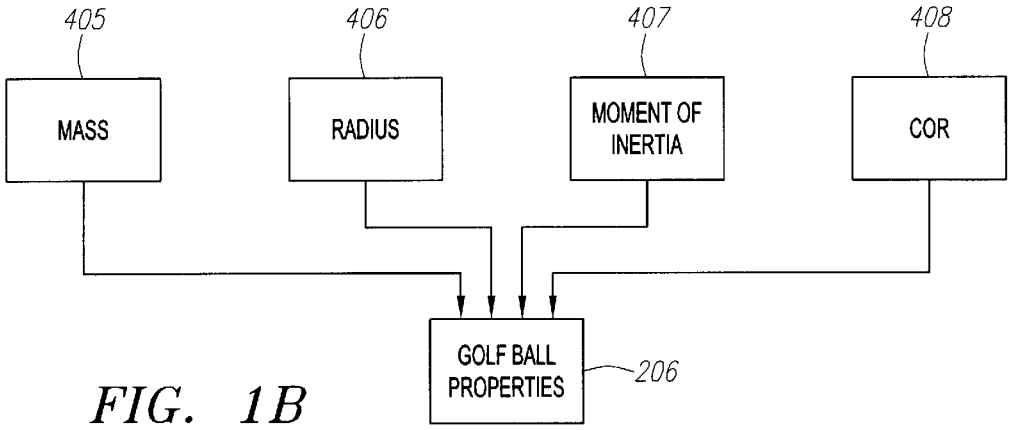
FIG. 1B is a flow chart illustrating the inputs for the golf ball properties.

FIG. 1B is a flow chart illustrating the inputs for the golf ball properties of block 206. The measurement of the mass of the golf ball is collected at block 405. The measurement of the radius of the golf ball is collected at block 406. The measurement of the moment of inertia of the golf ball is collected at block 407. The measurement of the coefficient of restitution of the golf ball is collected at block 408. The data collected at blocks 405–408 is inputted to create the golf ball properties at block 206 of FIG. 1.

Figure 1C:
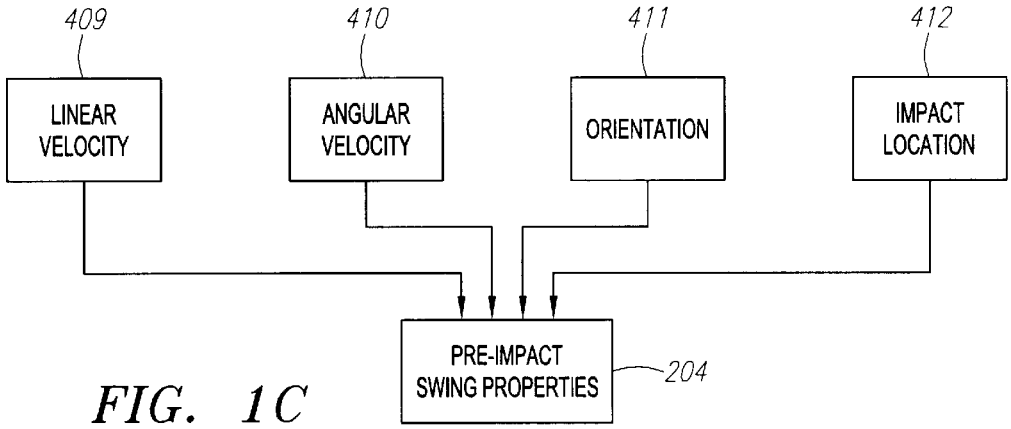
FIG. 1C is a flow chart illustrating the inputs for the pre-impact swing properties.

FIG. 1C is a flow chart illustrating the inputs for the pre-impact swing properties of block 204. The measurement of the linear velocity of the golf club being swung by the golfer is collected at block 409. The measurement of the angular velocity of the golf club being swung by the golfer is collected at block 410. The measurement of the golf club head orientation is collected at block 411. The information of the club head impact location with the golf ball is determined at block 412. The data collected at blocks 409–412 is inputted to create the pre-impact swing properties at block 204 of FIG. 1.

Figure 1D:
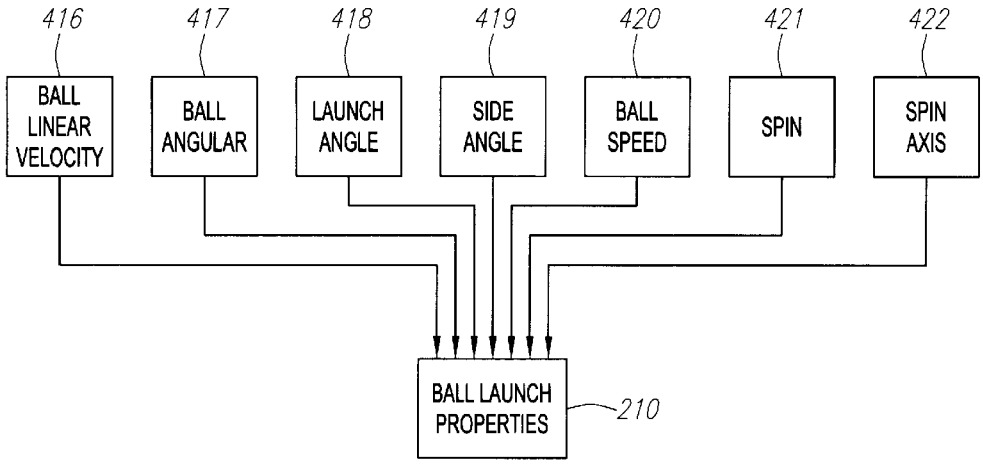
FIG. 1D is a flow chart of the inputs for the ball launch parameters.

FIG. 1D is a flow chart of the inputs for the ball launch parameters at block 210 of FIG. 1. The post impact linear velocity of the golf ball is calculated at block 416. The post impact angular velocity of the golf ball is calculated at block 417. The launch angle of the golf ball is calculated at block 418. The side angle of the golf ball is calculated at block 419. The speed of the golf ball is calculated at block 420. The spin of the golf ball is calculated at block 421. The spin axis of the golf ball is calculated at block 421. The information from blocks 416–421 is inputted to the ball launch parameters at block 210 of FIG. 1.

Figure 1E:
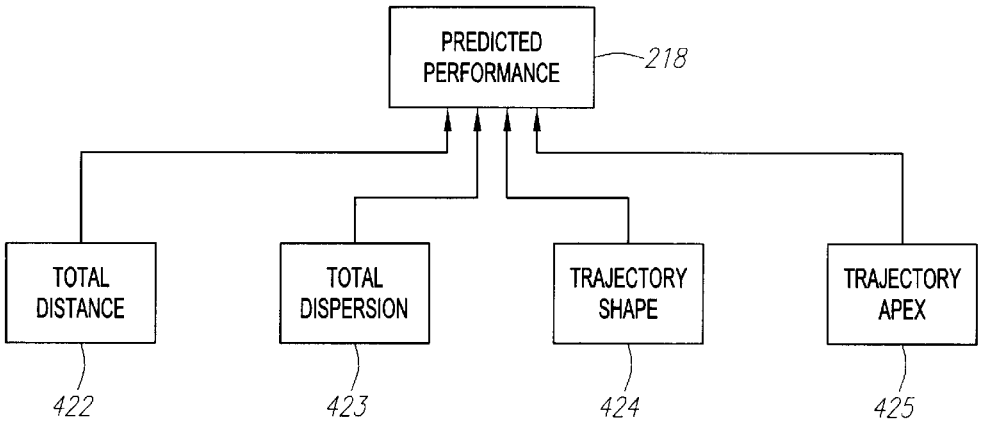
FIG. 1E is a flow chart of the outputs that are generated for the predicted performance.
Figure 2:
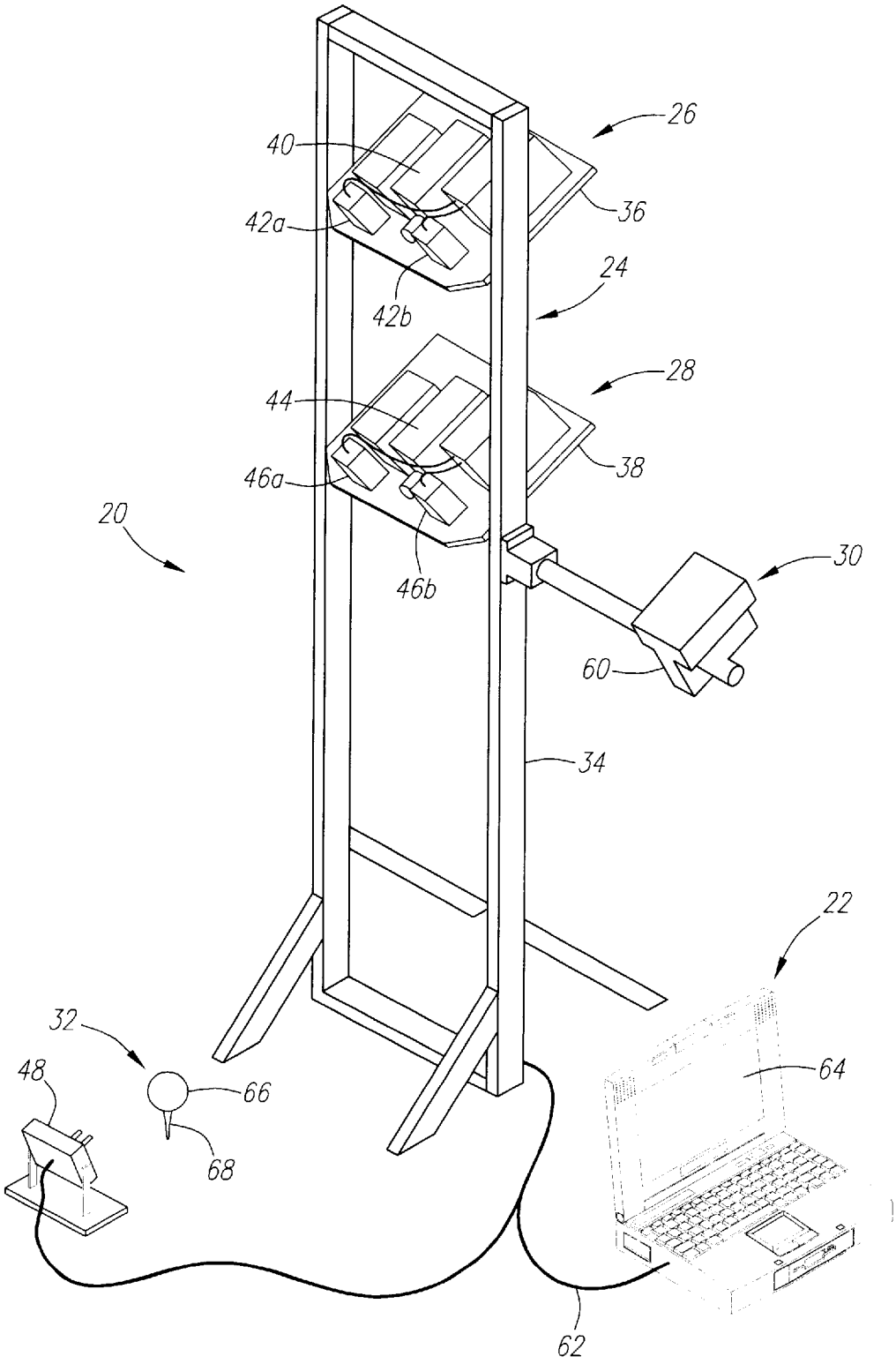
FIG. 2 is a perspective view of the monitoring system of the present invention.

FIG. 1E is a flow chart of the outputs from the trajectory code that are generated for the predicted performance of block 218 of FIG. 1. Block 422 is the predicted total distance of the golf ball if struck with a specific golf club by a golfer. Block 423 is the predicted total dispersion of the golf ball if struck with a specific golf club by a golfer. Block 424 is the predicted trajectory shape (available in 3D or 2D) of the golf ball if struck with a specific golf club by a golfer. Block 425 is the predicted trajectory apex of the golf ball if struck with a specific golf club by a golfer.

The golf club head properties of block 202 that are collected and stored in the system include the mass of the golf club head, the face geometry, the face center location, the bulge radius of the face, the roll radius of the face, the loft angle of the golf club head, the lie angle of the golf club head, the coefficient of restitution (COR) of the golf club head, the location of the center of gravity, CG, of the golf club head relative to the impact location of the face, and the inertia tensor of the golf club head about the CG.

The mass, bulge and roll radii, loft and lie angles, face geometry and face center are determined using conventional methods well known in the golf industry. The inertia tensor is calculated using: the moment of inertia about the x-axis, Ixx; the moment of inertia about the y-axis, Iyy; the moment of inertia about the z-axis, Izz; the product of inertia Ixy; the product of inertia Izy, and the product of inertia Izx. The CG and the MOI of the club head are determined according to the teachings of co-pending U.S. patent application No. 09/796,951, entitled High Moment of Inertia Composite Golf Club, filed Feb. 27, 2001, assigned to Callaway Golf Company, the assignee of the present application, and hereby incorporated by reference in its entirety. The products of inertia Ixy, Ixz and Izy are determined according to the teachings of co-pending U.S. patent application No. 09/916,374, entitled Large Volume Driver Head with High Moments of Inertia, filed Jul. 26, 2001, assigned to Callaway Golf Company, the assignee of the present application, and hereby incorporated by reference in its entirety.

The COR of the golf club head is determined using a method used by the United States Golf Association (USGA) and disclosed at www.usga.org, or using the method and system disclosed in co-pending U.S. patent application No. 09/844,160, entitled Measurement Of The Coefficient Of Restitution Of A Golf Club, filed Apr. 27, 2001, assigned to Callaway Golf Company, the assignee of the present application, and hereby incorporated by reference in its entirety. However, the COR of the golf club head is predicated on the golf ball, and will vary for different types of golf balls.

The golf ball properties of block 206 that are stored and collected include the mass of the golf ball (the Rules of Golf, as set forth by the USGA and the R&A, limit the mass to 45 grams or less), the radius of the golf ball (the Rules of Golf require a diameter of at least 1.68 inches), the COR of the golf ball and the MOI of the golf ball. The MOI of the golf ball may be determined using method well known in the industry. One such method is disclosed in U.S. Pat. No. 5,899,822, which pertinent parts are hereby incorporated by reference. The COR is determined using a method such as disclosed in co-pending U.S. patent application Number 09/877,651, entitled Golf Ball With A High Coefficient Of Restitution, filed Jun. 8, 2001, assigned to Callaway Golf Company, the assignee of the present application, and which pertinent parts are hereby incorporated by reference.

The pre-impact swing properties are preferably determined using an acquisition system such as disclosed in co-pending U.S. patent application Number 09/765,691, entitled System And Method For Measuring A Golfer's Ball Striking Parameters, filed Jan. 19, 2001, assigned to Callaway Golf Company, the assignee of the present application, and hereby incorporated by reference in its entirety. However, those skilled in the pertinent art will recognize that other acquisition systems may be used to determine the pre-impact swing properties.

The pre-impact swing properties include golf club head orientation, golf club head velocity, and golf club spin. The golf club head orientation includes dynamic lie, loft and face angle of the golf club head. The golf club head velocity include; path of the golf club head and attack of the golf club head.

The acquisition system 20 generally includes a computer 22, a camera structure 24 with a first camera unit 26, a second camera unit 28 and a trigger device 30, a teed golf ball 32 and a golf club 33. The acquisition system 20 is designed to operate on-course, at a driving range, inside a retail store/showroom, or at similar facilities.

The first camera unit 26 includes a first camera 40 and flash units 42*a* and 42*b*. The second camera unit 28 includes a second camera 44 and flash units 46*a* and 46*b*. A preferred camera is a charged coupled device (CCD) camera available from Wintriss Engineering of California under the product name OPSISC 1300 camera.

The trigger device 30 includes a receiver 48 and a transmitter 60. The transmitter 60 is preferably mounted on the frame 34 a predetermined distance from the camera units 26 and 28. A preferred trigger device is a laser device that transmits a laser beam from the transmitter 60 to the receiver 48 and is triggered when broken by a club swung toward the teed golf ball 32. The teed golf ball 32 includes a golf ball 66 and a tee 68. Other trigger devices such as optical detectors and audible detectors may be used with the present invention. The teed golf ball 32 is a predetermined length from the frame 34, $L_1$, and this length is preferably 38.5 inches. However, those skilled in the pertinent art will recognize that the length may vary depending on the location and the placement of the first and second camera units 26 and 28. The transmitter 50 is preferably disposed from 10 inches to 14 inches from the cameras 40 and 44. The receiver 48 and transmitter 60, and hence the laser beam, are positioned in front of the teed ball 32 such that a club swing will break the beam, and hence trigger the trigger device 30 prior to impact with the teed ball 32. As explained in greater detail below, the triggering of the trigger device 30 will generate a command to the first and second camera units 26 and 28 to begin taking exposures of the golf club 33 prior to impact with the teed golf ball 32. The data collected is sent to the computer 22 via a cable 62, which is connected to the receiver 48 and the first and second camera units 26 and 28. The computer 22 has a monitor 64 for displaying an image frame generated by the exposures taken by the first and second camera units 26 and 28. The image frame is the field of view of the cameras 40 and 44.

A first golf club 33 is preferably prepared for use with the system 20 to determine the pre-impact properties. Typically, the acquisition system 20 will take the average of ten swings from a single golfer to determine the pre-impact properties. These pre-impact swing properties will then be used to predict that particular golfer's performance with other golf clubs and golf balls under various atmospheric conditions without the golfer having to actually strike different golf balls with different golf clubs under various conditions.

Figures 3, 3A:
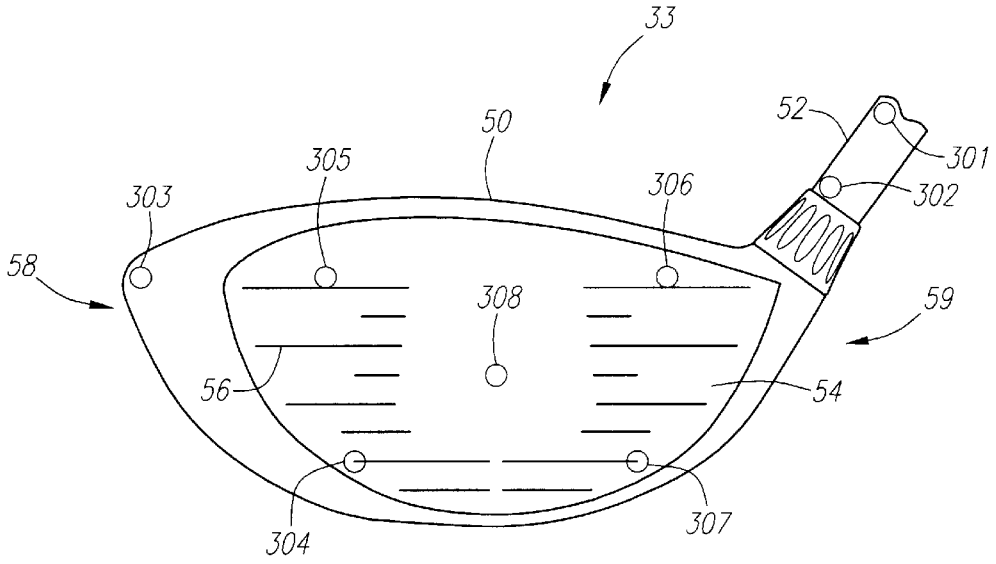
FIG. 3 is a front view of a golf club with markers for use in determining the pre-impact properties.
FIG. 3A is a graphic of global coordinates of the markers on the golf club of FIG. 3.

As shown in FIG. 3, the golf club 33 has a club head 50, a shaft 52, a face 54, scorelines 56, a toe end 58 and a heel end 59. A plurality of markers are preferably placed on the golf club 33 to highlight specific locations of the golf club 33. Only three marks are needed on the golf club to determine the pre-impact swing properties. A preferred embodiment is shown in FIG. 3. However, the acquisition system 20 is capable of using the basic features of the golf club 33 such as the scorelines, without the need for markers. A first marker 301 is placed on a tip end of the shaft 52. A second marker 302 is placed lower on the tip end of the shaft 52 than the first marker 301. A third marker 303 is placed on the high toe end 58 of the club head 50. A fourth marker 304 is placed on a low toe end of the face 54. A fifth marker 305 is placed on a high toe end of the face 54. A sixth marker 306 is placed on a high heel end of the face 54. A seventh marker 307 is placed on a low heel end of the face 54. An eighth marker 308 is placed in the center of the face 54.

Figure 5:
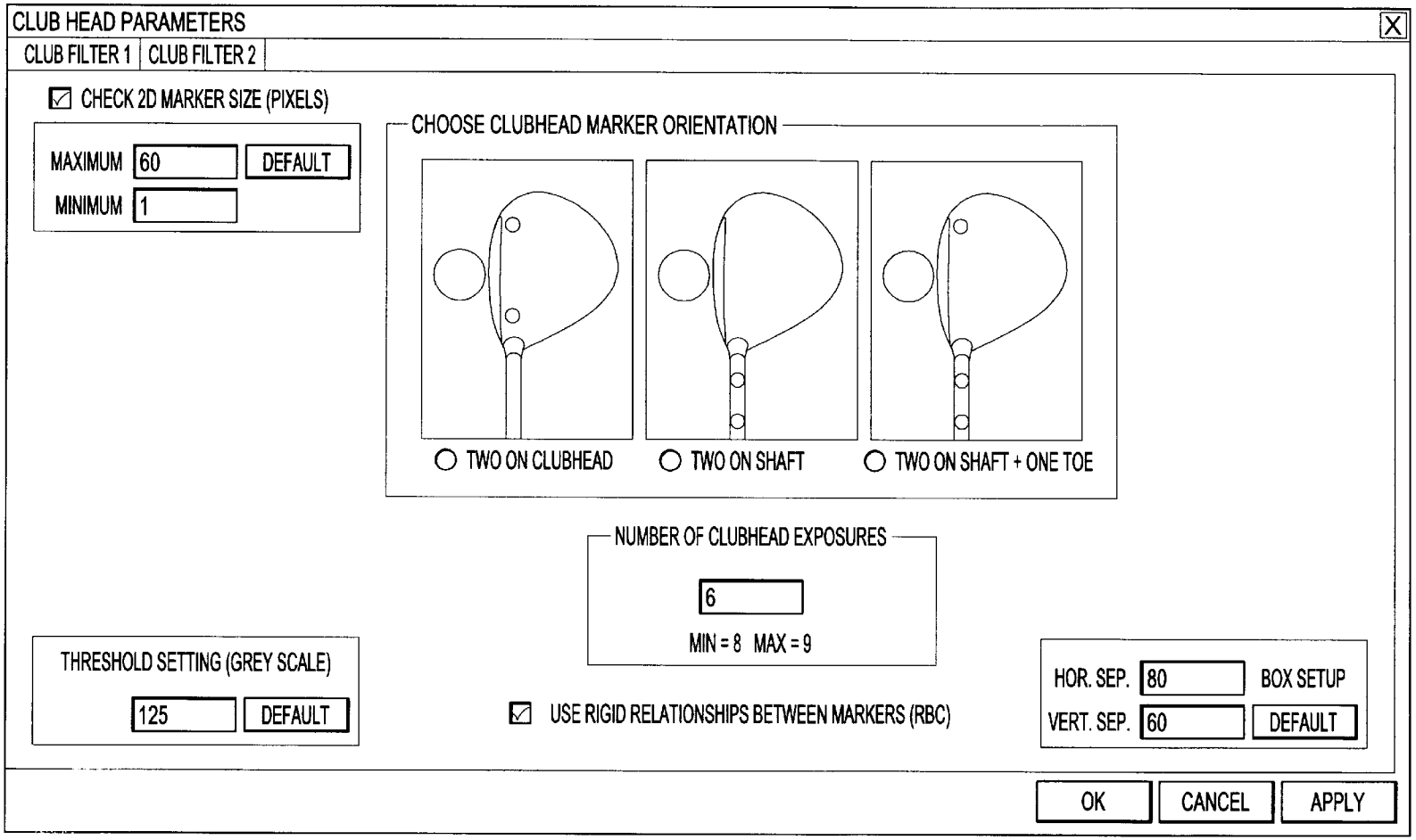
FIG. 5 illustrates an input screen.

An image frame of the golf club 33 of FIG. 3 is created by the acquisition system 20 to determine the location of the markers 304–308 or the scorelines relative to the markers 301–303. The loft, lie and face angle of the golf club are determined relative to the markers 301–303. This allows for the true golf club head 50 orientation to be measured from the markers 301–303. It is preferred that the markers 301–308 are highly reflective adhesive labels or be inherent with the golf club design. The markers 301–308 are preferred to be highly reflective since the cameras 40 and 44 are programmed to search for two or three points that have a certain brightness such as 200 out of a grey scale of 0–255. Two or more pre-impact exposures of the golf club 33 being swung by the golfer are acquired by the system 20. A preferred range of pre-impact exposures is three to nine, with six pre-impact exposures being the most preferred number. FIG. 5 illustrates an input screen to input the number and spacing of the exposures, the threshold level, the size of the points and the rigid relationship from the initial orientation screen.

Figure 4:
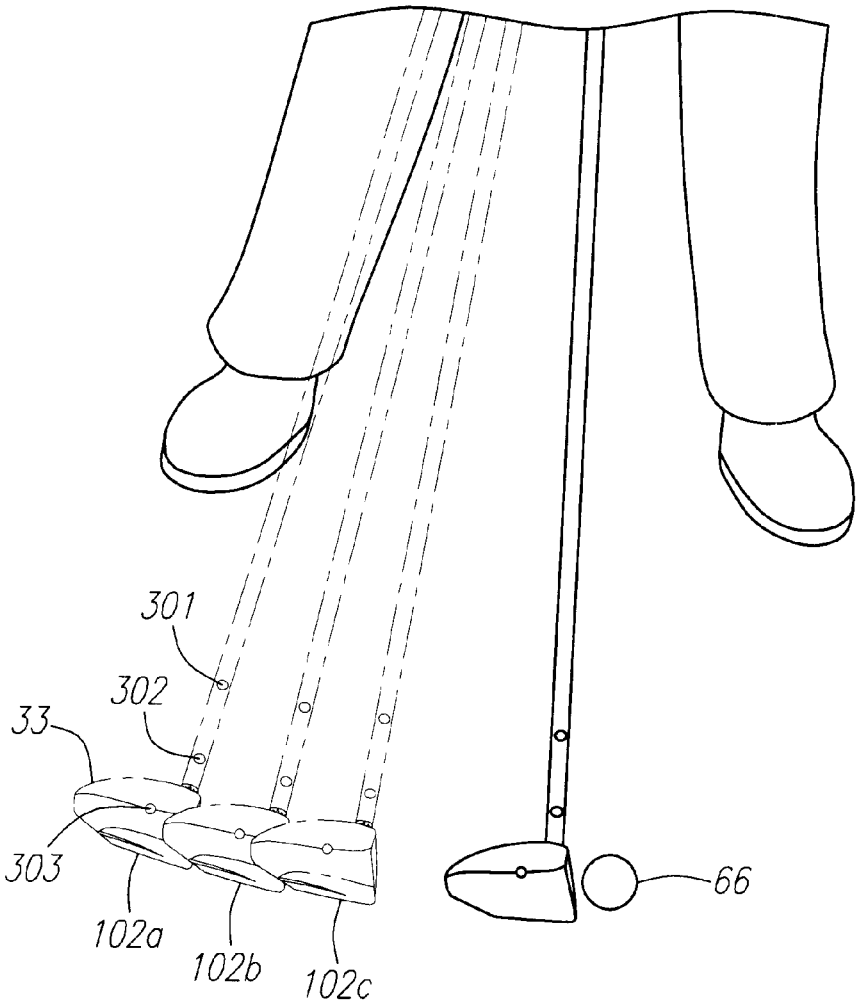
FIG. 4 is an image frame of a golfer's swing composed of a multitude of pre-impact exposures.

FIG. 4 is an image frame of four pre-impact exposures for a golfer swinging a golf club 33. A first exposure 102*a*, a second exposure 102*b*, a third exposure 102*c* and a fourth exposure 102*d* illustrate the golf club 33 prior to impact with the golf ball 66. The markers 301–303 are located in two dimensions, and then correlated in three dimensions. The marker 303 is correlated to the markers 301 and 302 on the shaft 52. The position of the face 54 and the tee ball 32 prior to impact our reconstructed and inputted to determine the pre-impact properties.

Figure 6:
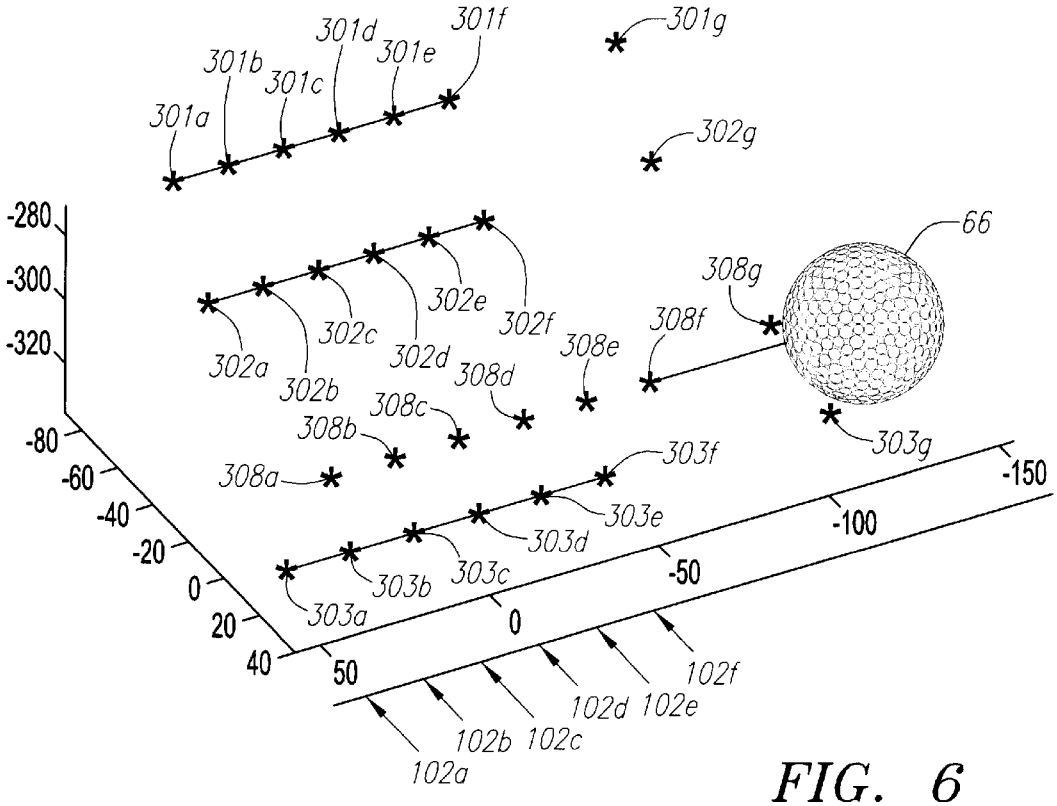
FIG. 6 is an illustration of markers of a golf club on a three-dimensional plot for six pre-impact exposures.

FIG. 6 is an illustration of the markers 301, 302, 303 and 308 of a golf club 33 on a three-dimensional plot for six pre-impact exposures 102*a*–102*f*. The markers 301, 302, 303 and 308 for each exposure 102*a*–102*f* are designated 301*a*, 301*b*, 301*c*, . . . etc. The global coordinates of the markers of FIG. 6 are illustrated in FIG. 6B.

In the example of FIG. 6, the first exposure 102*a* is taken at 100 microseconds after the trigger. The second exposure 102*b* is taken at 474.6 microseconds after the trigger. The third exposure 102*c* is taken at 849.3 microseconds after the trigger. The fourth exposure 102*d* is taken at 1223.9 microseconds after the trigger. The fifth exposure 102*e* is taken at 1598.6 microseconds after the trigger. The sixth exposure 102*f* is taken at 1973.2 microseconds after the trigger.

In addition the location of the golf ball prior to impact is found. The ball location may be found prior to the player starting the back swing, assumed to be the same location from a previous shot, or found in the image. To determine the orientation of the golf club face 54 prior to impact the orientation of the markers discussed previously in FIG. 3 are oriented relative to the markers in FIG. 6. Where Ra and Ta are the rotation and translation matrix between 301*a*, 302*a*, 303*a* and 301, 302, 303 and Rb and Tb are the rotation and translation matrix between 301*b*, 302*b*, 303*b* etc.

[Point 308*a*]=[Point 308]*Ra+Ta.

[Point 308*b*]=[Point 308]*Rb+Tb, etc.

Figure 6A:
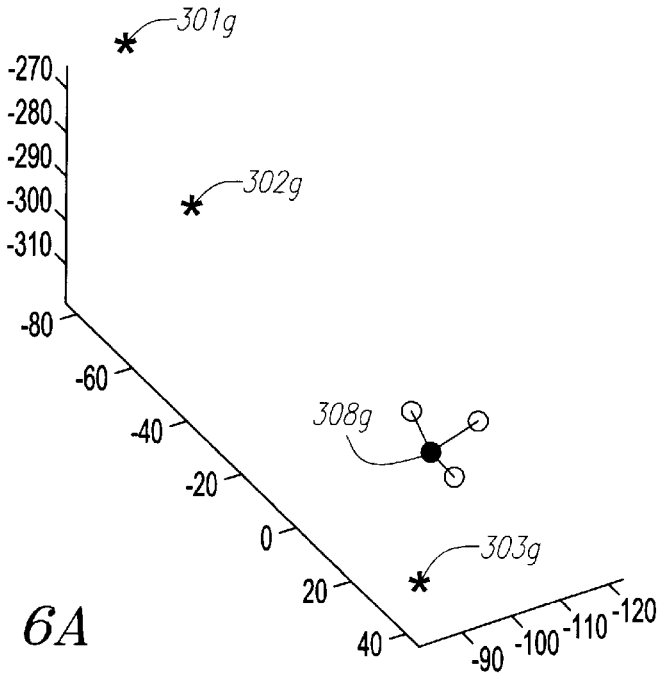
FIG. 6A is a three-dimensional plot of the extrapolated head position and orientation.

Using the equation, any point previously found on the golf club face 54 can be modeled from the measured points. From point 308*f* and the tee ball location, an estimate of the extrapolation time to impact can be made. Then, each series of points is curve fit with a second order curve fit and evaluated at the extrapolated time to give points 301*g*, 302*g*, and 303*g* of FIG. 6A. The extrapolated position data is used to calculate a new rotation and translation matrix and 308*g* is located. Any feature on the face 54 can be rotated and translated to the impact position using this method and a vector normal to the face 54 created and located on the center of the face 54. The initial impact location is defined as the location from the center of the tee ball 66 along the direction normal to the golf club face 54 and intersecting with the club head 50. The initial impact location needs to be modified to correct for the amount that the ball will deform on the golf club face. A simple method is to correct the vertical impact location Vertical Correction=12.5/25.4* sin(loft attack angle). Lateral Correction=12.5/25.4* sin (face angle path angle). More complex methods can be used to correct for the initial impact location. The 12.5 mm is dependent on the swing speed of the club and is based on a 100 MPH swing. The slower the golf club head speed, the smaller the value. 308*a* 308*g* and the image times are curve fit and Vx, Vy, and Vz are resolved for Rigid Body Code.

Based on these six exposures 102*a*–102*f*, the predicted impact is at 2962.4 microseconds after the trigger. Based on this information, the pre-impact swing properties are calculated for the golfer.

Once the pre-impact swing properties are determined (calculated), the rigid body code is used to predict the ball launch parameters. The rigid body code solves the impact problem using conservation of linear and angular momentum, which gives the complete motion of the two rigid bodies. The impulses are calculated using the definition of impulse, and the equations are set forth below. The coordinate system used for the impulse equations is set forth below. The impulse-momentum method does not take in account the time history of the impact event. The collision is described at only the instant before contact and the instant after contact. The force transmitted from the club head to the ball is equal and opposite to the force transmitted from the ball to the club head. These forces are conveniently summed up over the period of time in which the two objects are in contact, and they are called the linear and angular impulses.

The present invention assumes that both the golf ball 66 and the golf club head 50 are unconstrained rigid bodies, even though the golf club head 50 is obviously connected to the shaft 52, and the ball 66 is not floating in air upon impact with the golf club head 50. For the golf club head 50, the assumption of an unconstrained rigid body is that the impact with the golf ball 66 occurs within a very short time frame (microseconds), that only a small portion of the tip of the shaft 52 contributes to the impact. For the golf ball 66, the impulse due to friction between itself and the surface it is placed upon (e.g. tee, mat or ground) is very small in magnitude relative to the impulse due to the impact with the golf club head 50, and thus this friction is ignored in the calculations.

In addition to the normal coefficient of restitution, which governs the normal component of velocity during the impact, there are coefficients of restitution that govern the tangential components of velocity. The additional coefficients of restitution are determined experimentally.

The absolute performance numbers are defined in the global coordinate system, or the global frame. This coordinate system has the origin at the center of the golf ball, one axis points toward the intended final destination of the shot, one axis points straight up into the air, and the third axis is normal to both of the first two axis. The global coordinate system preferably follows the right hand rule.

The coordinate system used for the analysis is referred to as the impact coordinate system, or the impact frame. This frame is defined relative to the global frame for complete analysis of a golf shot. The impact frame is determined by the surface normal at the impact location on the golf club head 50. The positive z-direction is defined as the normal outward from the golf club head 50. The plane tangent to the point of impact contains both the x-axis and the y-axis. For ease of calculation, the x-axis is arbitrarily chosen to be parallel to the global ground plane, and thus the yz-plane is normal to the ground plane. The impact frame incorporates the loft, bulge and roll of a club head, and also includes the net result of the golf swing. Dynamic loft, open or close to the face, and toe down all measured for definition of the impact frame. Motion in the impact frame is converted to equivalent motion in the global frame since the relationship between the global coordinate system and the impact coordinate system is known. The post impact motion of the golf ball 66 is used as inputs in the Trajectory Code, and the distance and deviation of the shot is calculated by the present invention.

The symbols are defined as below:

$\vec{i}$=(1 0 0), the unit vector in the x-direction.

$\vec{j}$=(0 1 0), the unit vector in the y-direction.

$\vec{k}$=(0 0 1), the unit vector in the z-direction.

$m_1$, the mass of the club head.

$m_2$, the mass of the golf ball.

$$[I]_1 = \begin{bmatrix} I_{xx,1} & -I_{xy,1} & -I_{xz,1} \\ -I_{xy,1} & I_{yy,1} & -I_{yz,1} \\ -I_{xz,1} & -I_{yz,1} & I_{zz,1} \end{bmatrix},$$

$$[I]_2 = \begin{bmatrix} I_{xx,2} & -I_{xy,2} & -I_{xz,2} \\ -I_{xy,2} & I_{yy,2} & -I_{yz,2} \\ -I_{xz,2} & -I_{yz,2} & I_{zz,2} \end{bmatrix},$$

$\vec{r}_1=(a_1\ b_1\ c_1)$,the vector from point of impact to the center of gravity of the club head.

$\vec{r}_2=(a_2\ b_2\ c_2)$, the vector from point of impact to the center of gravity of the golf ball.

$\vec{r}_3=-\vec{r}_1+\vec{r}_2=(-a_1, +a_2\ -b_1+b_2\ -c_1+c_2)=(a_3\ b_3\ c_3)$, the vector from center of gravity of club head to the center of gravity of the golf ball.

$\vec{v}_{1,f}=(v_{x,1,f}\ v_{y,1,f}\ v_{z,1,f})$, the velocity of the club head before impact.

$\vec{v}_{1,f}=(v_{x,1,f}\ v_{y,1,f}\ v_{x,1,f})$, the velocity of the club head after impact.

$\vec{v}_{1,f}=(v_{x,1,f}\ v_{y,1,f}\ v_{z,1,f})$, the velocity of the golf ball before Impact $\vec{v}_{2,f}=(v_{x,2,f}\ v_{y,2,f}\ v_{z,2,f})$, the velocity of the golf ball after Impact.

$\vec{\omega}_{1,f}=(\omega_{x,1,f}\ \omega_{y,1,f}\ \omega_{z,1,f})$, the angular velocity of the club head before impact.

$\vec{\omega}_{1,f}=(\omega_{x,1,f}\ \omega_{y,1,f}\ \omega_{z,1,f})$, the angular velocity of the club head after impact.

$\vec{\omega}_{2,f}=(\omega_{x,2,f}\ \omega_{y,2,f}\ \omega_{z,2,f})$, the angular velocity of the golf ball before impact.

$\vec{\omega}_{2,f}=(\omega_{x,2,f}\ \omega_{y,2,f}\ \omega_{z,2,f})$, the angular velocity of the golf ball after impact.

$$[e] = \begin{bmatrix} e_{xx} & e_{xy} & e_{xz} \\ e_{xy} & e_{yy} & e_{yz} \\ e_{xz} & e_{yz} & e_{zz} \end{bmatrix},$$

the coefficient of restitution matrix.

$[L]=m\vec{v}$, definition of linear momentum.

$[H]=[I]\vec{\omega}$, definition of angular momentum. Conservation of linear momentum:

$$m_1\vec{v}_{1,f}+m_2\vec{v}_{2,f}=m_1\vec{v}_{1,f}+m_2\vec{v}_{2,f} \qquad \text{B1–B3}$$

Conservation of angular momentum:

$$([I])_1\vec{\omega}_{1,f}+([I])_2\vec{\omega}_{2,f}+m_1\begin{bmatrix} -c_1v_{y,1,f}+b_1v_{z,1,f} \\ c_1v_{x,1,f}-a_1v_{z,1,f} \\ a_1v_{y,1,f}-b_1v_{x,1,f} \end{bmatrix}+ \qquad \text{B4–B6}$$

$$m_2\begin{bmatrix} -c_2v_{y,2,f}+b_2v_{z,2,f} \\ c_2v_{x,2,f}-a_2v_{z,2,f} \\ a_2v_{y,2,f}-b_2v_{x,2,f} \end{bmatrix}=([I])_1\vec{\omega}_{1,f}+([I])_2\vec{\omega}_{2,f}+$$

$$m_1\begin{bmatrix} -c_1v_{y,1,f}+b_1v_{z,1,f} \\ c_1v_{x,1,f}-a_1v_{z,1,f} \\ a_1v_{y,1,f}-b_1v_{x,1,f} \end{bmatrix}+m_2\begin{bmatrix} -c_2v_{y,2,f}+b_2v_{z,2,f} \\ c_2v_{x,2,f}-a_2v_{z,2,f} \\ a_2v_{y,2,f}-b_2v_{x,2,f} \end{bmatrix}$$

The definition of coefficients of restitution:

$$-[e]\begin{bmatrix} (v_{x,2,i}+\vec{i}\cdot(\vec{\omega}_{2,i}\times(-\vec{r}_2)))-(v_{x,1,i}+\vec{i}\cdot(\vec{\omega}_{1,i}\times(-\vec{r}_1))) \\ (v_{y,2,i}+\vec{j}\cdot(\vec{\omega}_{2,i}\times(-\vec{r}_2)))-(v_{y,1,i}+\vec{j}\cdot(\vec{\omega}_{1,i}\times(-\vec{r}_1))) \\ (v_{z,2,i}+\vec{k}\cdot(\vec{\omega}_{2,i}\times(-\vec{r}_2)))-(v_{z,1,i}+\vec{k}\cdot(\vec{\omega}_{1,i}\times(-\vec{r}_1))) \end{bmatrix}= \qquad \text{B7–B9}$$

$$\begin{bmatrix} (v_{x,2,f}+\vec{i}\cdot(\vec{\omega}_{2,f}\times(-\vec{r}_2)))-(v_{x,1,j}+\vec{i}\cdot(\vec{\omega}_{1,f}\times(-\vec{r}_1))) \\ (v_{y,2,f}+\vec{j}\cdot(\vec{\omega}_{2,f}\times(-\vec{r}_2)))-(v_{y,1,j}+\vec{j}\cdot(\vec{\omega}_{1,f}\times(-\vec{r}_1))) \\ (v_{z,2,f}+\vec{k}\cdot(\vec{\omega}_{2,f}\times(-\vec{r}_2)))-(v_{z,1,j}+\vec{k}\cdot(\vec{\omega}_{1,f}\times(-\vec{r}_1))) \end{bmatrix}$$

The tangential impulse on the ball causes both rotation and translation:

$$m_2\begin{bmatrix} c_2(v_{y,2,f}-v_{y,2,i})-b_2(v_{z,2,f}-v_{z,2,f}) \\ -c_2(v_{x,2,f}-v_{x,2,i})+a_2(v_{x,2,f}-v_{z,2,i}) \\ b_2(v_{x,2,f}-v_{x,2,i})-a_2(v_{y,2,f}-v_{y,2,i}) \end{bmatrix}= \qquad \text{B10–B12}$$

$$[I]_2\begin{bmatrix} \omega_{x,2,f}-\omega_{z,2,i} \\ \omega_{y,2,f}-\omega_{y,2,i} \\ \omega_{z,2,f}-\omega_{z,2,i} \end{bmatrix}$$

Equations B1–B12 can be combined to form a system of linear equations of the form:

$$[A]\{x\}=\{B\} \qquad \text{B13}$$

where [A], and {B} are determined from the known velocities before the impact, the mass properties of the golf ball 66 and golf club head 50, the impact location relative to the center of gravity of the golf ball 66 and the golf club head 50, and the surface normal at the point of impact. {x} contains all the post impact velocities (linear and angular), and is solved by pre-multiplying {B} by the inverse of [A], or any other method in solving system of equations in linear algebra.

When the golf ball 66 is sitting on the tee 68, it is in equilibrium. The golf ball 66 will not move until a force that's greater than $F_m$ the maximum static friction force between the golf ball 66 and the tee 68, is applied on the golf ball 66.

$$F_m=\mu_s N=\mu_s m_2 g \quad \text{C1}$$

$\mu_s$ is the static coefficient of function and g is gravity. For a golf ball 66 with 45 grams of mass, and a $\mu_s$ of 0.3, $$F_m=\mu_s mg=(0.3)(0.045)(9.81)=0.132N$$

Assume this force is applied on the golf ball 66 far the duration of an impact of 0.0005 sec (which is an overestimation of the actual impulse), then the impulse, L, on the golf ball 66 is:

$$L=(0.132)(0.0005)=0.0000662N\cdot s$$

This impulse, L, would cause the golf ball 66 to move at 0.00147 m/s (or 0.00483 f/sec), and rotate at 8.08 rad/sec (or 77.1 rpm). Both of these numbers are small relative to the range of numbers normally seen for irons and woods. If the rigid body code of the present invention were to be applied to putters, then it would be preferable to include the friction force between the green and the golf ball 66 for the analysis.

$$[e]=\begin{bmatrix} e_{xx} & e_{xy} & e_{xz} \\ e_{xy} & e_{yy} & e_{yz} \\ e_{xz} & e_{yz} & e_{zz} \end{bmatrix}$$

Each of the individual terms in the above matrix, $e_{ij}$, where i=x, y, z, and j=x, y, z, relates the velocity in the i-direction to the j-direction. Each of the diagonal terms, where i=j, indicate the relationship in velocity of one of the axis, x, y, or z, before and after the impact. Let x, y, z be the axis defined in the impact frame. The term $e_{zz}$ includes all the energy that is lost in the impact in the normal direction of impact. $e_{xx}$ and $e_{yy}$ account for the complicated interaction between the golf ball 66 and the golf club head 50 in the tangential plane by addressing the end result. In general, the off diagonal terms $e_{ij}$ where i≠j, are equal to zero for isotropic materials.

Figure 7:
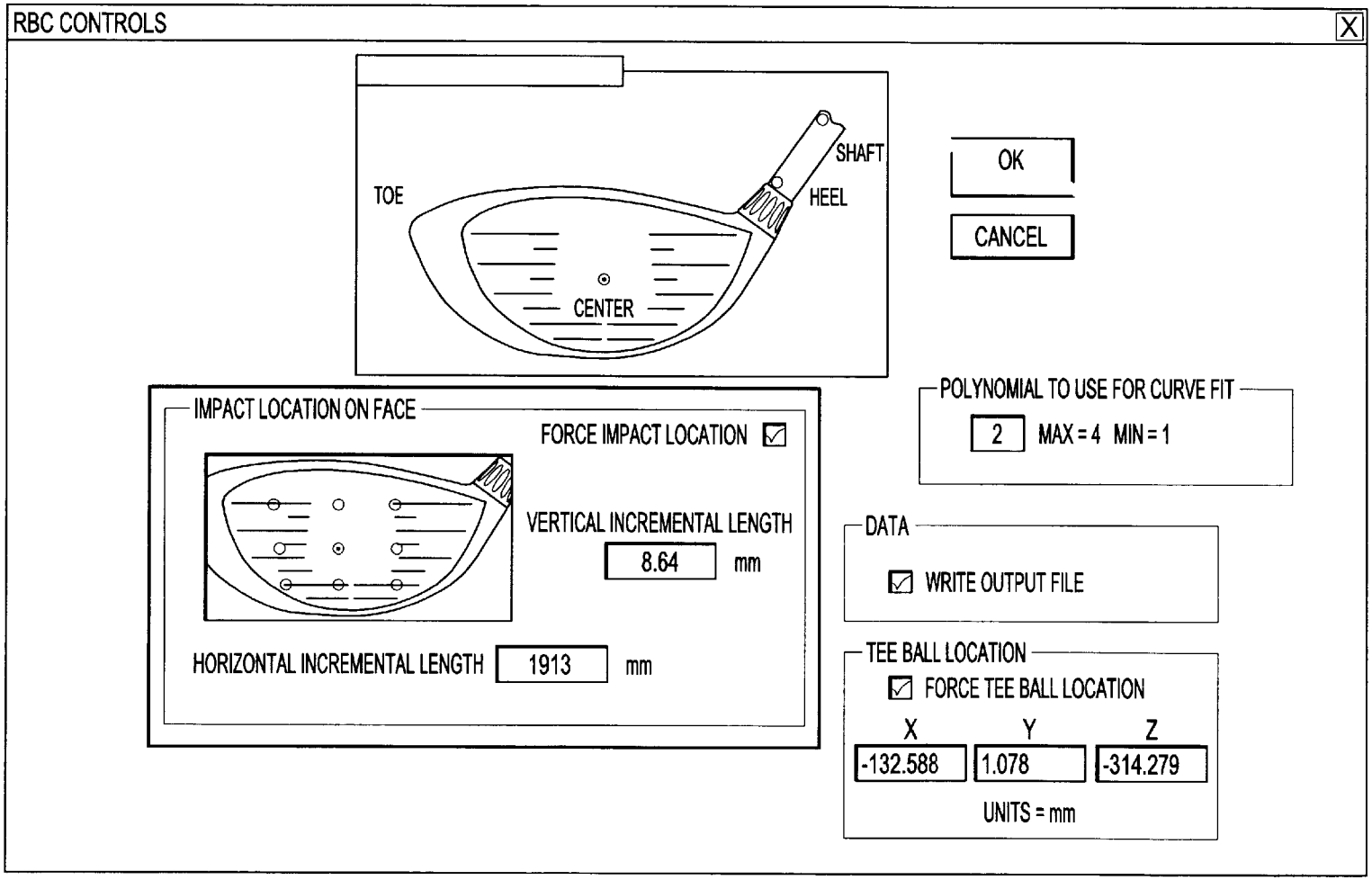
FIG. 7 is a graphic of an input menu for impact locations.

As shown in FIG. 7, in predicting the performance of a golf ball struck by a golfer with a specific golf club under predetermined atmospheric conditions, an operator has the option of inputting an impact of the face 54 at a certain location regardless of the true location of impact. This allows for prediction of the performance of the golf club 33 for toe shots, heel shots and center shots. The type of golf ball may be selected, the type of golf club may be selected, the atmospheric conditions including wind speed, direction, relative humidity, air pressure, temperature and the terrain may be selected by the operator to predict a golfer's performance using these input parameters along with the pre-impact swing properties for the golfer.

The method of the present invention for predicting the performance of two different golfers, using two different golf clubs, with two different golf balls under two different atmospheric conditions is illustrated in FIGS. 8–17. Golfer B has a higher swing speed than Golfer A. Golfers A and B swing a test club 10 times for an average of the swing of each golfer. The predicted performances are for a golf club head 50 composed of steel and a golf club head composed of titanium, a 2-piece golf ball with an ionomer blend cover and a three-piece (wound) golf ball with a balata cover, and atmospheric conditions of a warm day and a cold day.

Figure 8:
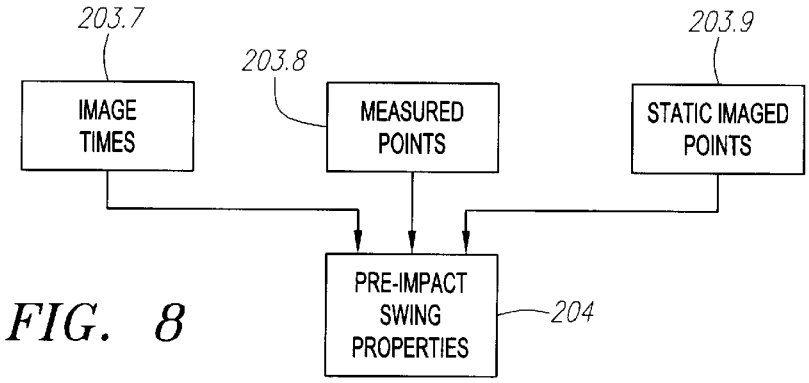
FIG. 8 is a flow chart of the components of the pre-swing properties of FIG. 1.
Figure 9:
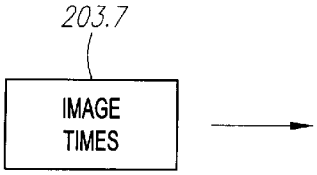
FIG. 9 is a table of the image times (in microseconds) of FIG. 8 for Golfer A and Golfer B.
Figure 10:
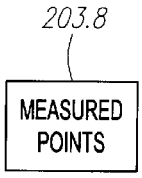
FIG. 10 is a table of the measured points (in millimeters) of FIG. 8 for Golfer A and Golfer B.

FIG. 8 is a flow chart of the components of the pre-swing properties of block 204 of FIG. 1. The components or inputs include the image times at block 203.7, the measured points at block 203.8 and the static imaged points at block 203.9. FIG. 9 is a table of the image times (in microseconds) of block 203.7 for Golfer A and Golfer B. FIG. 10 is a table of the measured points (in millimeters) of block 203.8 for Golfer A and Golfer B. FIG. 11 is a table of the static image points (in millimeters) of block 203.9 for Golfer A and Golfer B.

FIG. 12 is a table of the golf club head properties of block 202 for golf club heads 50 composed of titanium (Ti) and steel. Blocks 401–404 of FIG. 1A are included along with optional hosel height and Spin COR inputs.

FIG. 13 is a table of the pre-impact swing properties of block 204 for each of the Golfers A and B. The table includes information for blocks 409–412 of FIG. 1C.

FIG. 14 is a table of the golf ball properties of block 206 with information for blocks 405–408 of FIG. 1B.

FIG. 15 is a table of the ball launch parameters of block 210 generated by the rigid body code. The table includes information for blocks 416–422 of FIG. 1D.

FIG. 16 is a table of the atmospheric conditions of block 214.

FIG. 17 is a table of the predicted performance of block 218 which is generated by the trajectory code. The table includes information for blocks 422–425 of FIG. 1E.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A method for predicting a golfer's ball striking performance, the method comprising:

providing a plurality of golf club head properties for a first golf club head of a first golf club;

providing a plurality of golf ball properties for a first golf ball;

determining a plurality of pre-impact swing properties for the golfer;

generating a plurality of ball launch parameters from the plurality of golf club head properties, the plurality of golf ball properties and the plurality of pre-impact swing properties;

providing a plurality of first atmospheric conditions;

providing a plurality of lift and drag properties for the first golf ball;

inputting the plurality of ball launch parameters, the plurality of first atmospheric conditions and the plurality of lift and drag properties into a trajectory code; and generating a predicted performance from the trajectory code of the first golf ball if struck with the first golf club by the golfer under the first atmospheric conditions.

2. The method according to claim 1 wherein predicting the performance comprises predicting a trajectory shape, a trajectory apex, a dispersion of the golf ball, a flight distance of the golf ball and a roll distance of the golf ball.

3. The method according to claim 1 wherein the plurality of golf club head properties comprises a mass of the first golf club head, a location of a center of gravity of the first golf club head relative to an impact location of the first golf ball, an inertia tensor of the first golf club head, a geometry of a face of the first golf club head, bulge and roll radii of the face of the first golf club head, a loft of the first golf club head and a face center location of the first golf club head.

4. The method according to claim 3 wherein the plurality of golf club head properties further comprises a coefficient of restitution of the first golf club head when striking the first golf ball, and a spin coefficient of restitution of the first golf club head when striking the first golf ball.

5. The method according to claim 1 wherein the plurality of golf ball properties comprises a mass of the first golf ball, a moment of inertia of the first golf ball and a radius of the first golf ball.

6. The method according to claim 5 wherein the plurality of golf ball properties further comprises a coefficient of restitution of the first golf ball at a speed of 143 feet per second.

7. The method according to claim 1 wherein the plurality of atmospheric conditions comprises a temperature, a pressure, a density of the air, a viscosity of the air, a relative humidity and a wind velocity.

8. The method according to claim 1 wherein the plurality of pre-impact properties comprises an impact location, a motion of the golf club head and an orientation of the golf club head.

9. The method according to claim 8 wherein the motion of the golf club head is provided as a three-orthogonal axes representation of velocity.

10. The method according to claim 8 wherein the motion of the golf club head is provided as speed and a directional vector represented by an elevation angle and an azimuth angle.

11. The method according to claim 1 wherein the plurality of ball launch parameters generated comprises a ball velocity and a ball angular velocity.

12. The method according to claim 1 wherein the plurality of ball launch parameters generated comprises a launch angle of the golf ball, a side angle of the golf ball, a golf ball speed, a spin of the golf ball and a spin axis of the golf ball.

13. The method according to claim 1 further comprising:

providing a plurality of golf club head properties for a second golf club head of a second golf club;

generating a second plurality of ball launch parameters from the plurality of golf club head properties for the second golf club head, the plurality of golf ball properties and the plurality of pre-impact swing properties;

inputting the second plurality of ball launch parameters, the plurality of first atmospheric conditions and the plurality of lift and drag properties into the trajectory code; and generating a predicted performance from the trajectory code of the first golf ball if struck with the second golf club by the golfer under the first atmospheric conditions.

14. The method according to claim 1 further comprising:

providing a plurality of golf ball properties for a second golf ball;

generating a second plurality of ball launch parameters from the plurality of golf club head properties, the plurality of golf ball properties for the second golf ball and the plurality of pre-impact swing properties;

providing a plurality of lift and drag properties for the second golf ball;

inputting the second plurality of ball launch parameters, the plurality of first atmospheric conditions and the plurality of lift and drag properties for the second golf ball into the trajectory code; and generating a predicted performance from the trajectory code of the second golf ball if struck with the first golf club by the golfer under the first atmospheric conditions.

15. The method according to claim 1 further comprising:

providing a plurality of second atmospheric conditions;

inputting the ball launch parameters, the plurality of second atmospheric conditions and the plurality of lift and drag properties into the trajectory code; and generating a predicted performance from the trajectory code of the first golf ball if struck with the first golf club by the golfer under the second atmospheric conditions.

16. A method for predicting a golfer's ball striking performance with a multitude of different golf clubs and a multitude of different golf balls, the method comprising:

determining a plurality of pre-impact swing properties for the golfer based on the golfer's swing with a first golf club;

inputting a plurality of mass properties of a first golf club, a plurality of mass properties of a first golf ball, and the plurality of pre-impact swing properties into a rigid body code;

generating a first plurality of ball launch parameters from the first rigid body code;

inputting the first plurality of ball launch parameters, a plurality of atmospheric conditions and a plurality of lift and drag properties for the first golf ball into a trajectory code;

generating the performance from the trajectory code of the first golf ball if struck by the golfer with the first golf club under the plurality of atmospheric conditions;

inputting a plurality of mass properties of a second golf club, the plurality of mass properties of the first golf ball, and the plurality of pre-impact swing properties into the rigid body code; generating a second plurality of ball launch parameters from the rigid body code;

inputting the second plurality of ball launch parameters, the plurality of atmospheric conditions and the plurality of lift and drag properties for the first golf ball into the trajectory code;

generating the performance from the trajectory code of the first golf ba I if struck by the golfer with the second golf club under the first atmospheric conditions;

inputting the plurality of mass properties of the first golf club, a plurality of mass properties of a second golf ball, and the plurality of pre-impact swing properties into the rigid body code;

generating a third plurality of ball launch parameters from the rigid boded code; inputting the third plurality of ball launch parameters, the plurality of atmospheric conditions and a plurality of lift and drag properties for the second golf ball into the trajectory code; and generating the performance from the trajectory code of the second golf ball if struck by the golfer with the first golf club under the atmospheric conditions.

17. The method according to claim 16 wherein the first golf ball is a two-piece golf ball and the second golf ball is a three-piece solid golf ball.

18. The method according to claim 16 wherein the first golf club is a driver with a golf club head composed of a cast titanium alloy material and the second golf club is a driver with a golf club head composed of a cast stainless steel alloy.

19. A method for predicting a golfer's ball striking performance, the method comprising:

determining a plurality of pre-impact swing properties for the golfer based on the golfer's swing with a first golf club;

generating a plurality of ball launch parameters from a plurality of mass properties of the first golf club, a plurality of mass properties of a first golf ball, and the plurality of pre-impact swing properties;

providing a plurality of first atmospheric conditions;

providing a plurality of lift and drag properties for the first golf ball;

inputting the plurality of ball launch parameters, the plurality of first atmospheric conditions and the plurality of lift and drag properties into a trajectory code; and generating a trajectory shape, a trajectory apex, a dispersion of the golf ball, a flight distance of the golf ball and a roll distance of the first golf ball from the trajectory code if struck by the golfer with the first golf club under the first atmospheric conditions.

20. A method for predicting a golfer's ball striking performance, the method comprising:

determining a plurality of pre-impact swing properties for the golfer based on the golfer's swing with a first golf club, wherein the plurality of pre-impact properties comprises an impact location, a motion of the golf club head and an orientation of the golf club head;

inputting a plurality of mass properties of the first golf club, a plurality of mass properties of a first golf ball, and the plurality of pre-impact swing properties into equations B1–B13;

generating a first plurality of ball launch parameters from equations B1–B13;

providing a plurality of first atmospheric conditions;

providing a plurality of lift and drag properties for the first golf ball;

inputting the first plurality of ball launch parameters, the plurality of first atmospheric conditions and the plurality of lift and drag properties into a trajectory code;

generating a trajectory shape, a trajectory apex, a dispersion of the golf ball, a flight distance of the golf ball and a roll distance of the first golf ball from the trajectory code if struck by the golfer with the first golf club under the first atmospheric conditions;

generating a second plurality of ball launch parameters from a plurality of mass properties of a second golf club, the plurality of mass properties of the first golf ball, and the plurality of pre-impact swing properties;

inputting the second plurality of ball launch parameters, the plurality of first atmospheric conditions and the plurality of lift and drag properties into the trajectory code; and generating the trajectory shape, the trajectory apex, the dispersion of the golf ball, the flight distance of the golf ball and the roll distance of the first golf ball from the trajectory code if struck by the golfer with the second golf club under the first atmospheric conditions.

21. A method for predicting a golfer's ball striking performance, the method comprising:

determining a plurality of pre-impact swing properties for the golfer based on the golfer's swing with a first golf club, wherein the plurality of pre-impact properties comprises an impact location, a motion of the golf club head and an orientation of the golf club head;

generating a first plurality of ball launch parameters from a plurality of mass properties of the first golf club, a plurality of mass properties of a first golf ball, and the plurality of pre-impact swing properties, wherein the first plurality of ball launch parameters generated comprises a launch angle of the golf ball, a side angle of the golf ball, a golf ball speed, a spin of the golf ball and a spin axis of the golf ball;

providing a plurality of first atmospheric conditions;

providing a plurality of lift and drag properties for the first golf ball;

inputting the plurality of ball launch parameters, the plurality of first atmospheric conditions and the plurality of lift and drag properties into a trajectory code;

generating a trajectory shape, a trajectory apex, a dispersion of the golf ball, a flight distance of the golf ball and a roll distance of the first golf ball from the trajectory code if struck by the golfer with the first golf club under the first atmospheric conditions;

generating a second plurality of ball launch parameters from the plurality of mass properties of the first golf club, a plurality of mass properties of a second golf ball, and the plurality of pre-impact swing properties;

inputting the second plurality of ball launch parameters, the plurality of first atmospheric conditions and the plurality of lift and drag properties into the trajectory code; and generating the trajectory shape, the trajectory apex, the dispersion of the golf ball, the flight distance of the golf ball and the roll distance of the second golf ball from the trajectory code if struck by the golfer with the first golf club under the first atmospheric conditions.

* * * * *